United States Patent [19]

Ariotti et al.

[11] 4,190,018

[45] Feb. 26, 1980

[54] POWDER DENSITY CONTROL CIRCUIT FOR A PHOTOCOPIER

[75] Inventors: Robert C. Ariotti, Stamford; Harold M. Stahl, Ridgefield; Lawrence E. Clifford, Danbury, all of Conn.

[73] Assignee: Pitney-Bowes, Inc., Stamford, Conn.

[21] Appl. No.: 8,728

[22] Filed: Feb. 2, 1979

[51] Int. Cl.[2] ..... G03G 15/09

[52] U.S. Cl. ..... 118/690

[58] Field of Search ..... 118/690

[56] References Cited

U.S. PATENT DOCUMENTS

| | | | |
|---|---|---|---|
| 3,719,165 | 3/1973 | Trachienberg et al. | 118/690 |
| 3,892,672 | 7/1975 | Gawron | 118/690 X |
| 3,893,408 | 7/1975 | Lamel | 118/690 |
| 3,941,084 | 3/1976 | Kurita | 118/690 |
| 4,064,834 | 12/1977 | Sund | 118/690 |

*Primary Examiner*—James R. Hoffman

*Attorney, Agent, or Firm*—Martin D. Wittstein; William D. Soltow, Jr.; Albert W. Scribner

[57] ABSTRACT

A powder density control means is provided for use in a photocopier machine of the type in which a photoconductor is charged in accordance with an image to be recorded thereon and is developed by contact with a toner powder attracted thereto from a mixture of carrier particles and toner powder carried by a developer assembly including a replenishment means for periodically adding toner powder. A high value resistance and a bias supply are serially coupled to a magnetic brush of the developer assembly. The voltage across the magnetic brush provides an indication of how heavily the latent image on the photoconductor is being toned. The change in magnitude of the voltage on the brush is sensed and when a predetermined amount of voltage change is detected, an additional amount of toner powder is supplied by the replenisher to the developer unit for such change.

6 Claims, 2 Drawing Figures

POWDER DENSITY CONTROL CIRCUIT FOR A PHOTOCOPIER

BACKGROUND OF THE INVENTION

This invention relates to a toner powder density control for a photocopier device, and more particularly to such a control which maintains the toner powder density in the magnetic brush toning unit by replenishment in accordance with the amount of toning required by the latent image being copied.

In photocopier machines electrostatic charge patterns are produced corresponding to the image or light pattern of a subject which is desired to be copied. The image is developed by applying a powder or toner thereto which adheres to the image areas and is fixed thereon. The application of the toner powder requires the use of a carrier such as iron particles which triboelectrically hold the flocculent toner powder so that it may be brought into contact with the electrostatic charge pattern, separated from the carrier, and selectively deposited on the recording surface in accordance with charge. Rotating magnetic development brushes carry the toner coated metallic carrier particles into contact with the recording medium, and the toner is selectively attracted to the image in accordance with the charge thereon. As successive electrostatic charge patterns are developed and copies made, the toner is gradually depleted from the mixture requiring replenishment in order to obtain the proper ratio of toner to carrier, otherwise there will be a gradual change in the developed or toned images producing copies which are nonuniform, improperly shaded and thus diminish the reproduction quality of the copies.

A variety of techniques have been employed in an effort to overcome this problem. One such method optically senses the reflectivity of the toner powder in the development unit to determine whether replenishment is required. However, dust from the process collects on the optical sensor which often causes malfunctions of the unit leading to inadequate replenishment, carrier particle carry-out from the developer unit, and weak copies. Another method involves sampling noncharged areas which pass the brush and activating the replenisher when the potential of the noncharged areas drops below a predetermined value which produces undesirable variable effects on the potential when measured over charged areas. Another method measures the resistivity of the mix using a sensing means immersed in the mix which would be imprecise when carrier is lost and further would depend on the position of the probe as well as the agitation applied to the mix to maintain uniformity therein.

Other methods have similar problems.

SUMMARY OF THE INVENTION

Accordingly, it is an object of the present invention to provide powder density control unit which is simple and overcomes the aforesaid problems which are associated with prior art techniques.

A further object of this invention is to provide an improved powder density control means which provides a reliable method of replenishing toner powder in the development unit of a copier machine.

In carrying out this invention in one illustrative embodiment thereof, a powder density control means for use in a photocopier is provided in which a resistor stabilized bias power supply is coupled to the magnetic brush of a developer assembly of a photocopier machine. Changes in voltage of the resistor stabilized power supply are sensed during the toning of an image on a photoconductor, and means are provided in response to a change in voltage of the power supply above a predetermined level for controlling a replenishment means in order to control the amount of toner powder which is added to the developer assembly.

BRIEF DESCRIPTION OF THE DRAWINGS

The invention, both as to organization and method of operation together with further objects and advantages thereof, may be best understood by reference to the following description taken in connection with the accompanying drawings, in which.

DESCRIPTION OF THE PREFERRED EMBODIMENT

In the photocopying art a negative charge is laid down on a photoconductor which is exposed to an image to be copied. On exposure the charge is lost in the clear areas and remains concentrated in the dark areas of the image to be reproduced. The photoconductor is then passed into intimate contact with a magnetic brush of a developer unit for depositing toner powder from the developer unit which is attracted by the charge placed on the photoconductor by the image. The photoconductor also contains a residual charge unrelated to the image so a bias voltage supply is applied to the magnetic brush which counteracts the residual voltage on the photoconductor. The bias supply suppresses background disturbances caused by residual voltage on the photoconductor. The optimum bias voltage will depend upon the type and concentration of toner powder.

It has been found in accordance with the present invention that the current of the bias power supply to the magnetic brush of the developer unit is dependent on the required toning of the latent image on the photoconductor. The current of the bias supply varies in accordance with how black a copy is reproduced. The magnitude of the current drops significantly during toning, the drop being greater with heavier toning due to the effect of toner powder leaving the toning unit. These current variations could be measured and used to provide a new method of providing powder density control. However, the currents are small and on the order of several micro-amperes so in accordance with the preferred embodiment of this invention the voltage across the developer is sensed. This also allows the use of a high value resistance between the bias power supply and the magnetic developer brush to stabilize current variations during toning and thereby providing a more stable and reliable control.

Figure 1:
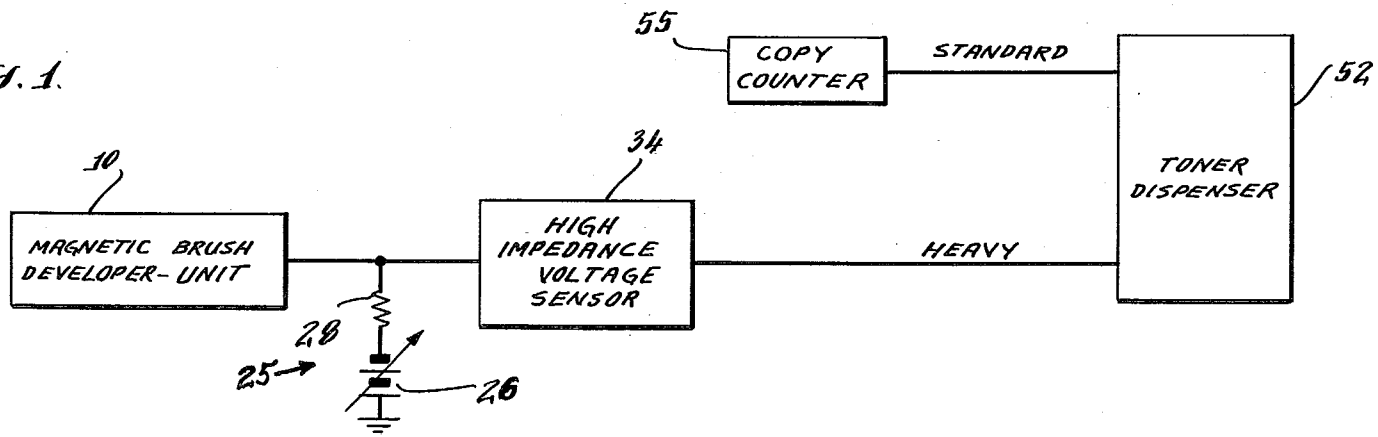
FIG. 1 is a block diagram of an illustrative embodiment of the present invention.

Referring now to FIG. 1 which shows an implementation of the invention in block form, a magnetic brush developer unit 10 is provided with a resistor stabilized bias power supply 25 comprised of a variable bias 26 and a resistor 28 having a high value on the order to several megohms and which are serially coupled to the magnetic brush. A high impedance voltage sensor 34 is coupled to the magnetic brush for measuring the voltage changes during the toning of a photoconductor.

When such voltage changes exceed a predetermined level corresponding to a reference level estabilished for a standard copy, an output designated "heavy" is applied to a toner dispenser 52 which meters out an extra amount of toner powder to replenish the supply in the magnetic brush development unit 10. A copy counter 55 is also provided which feeds a standard signal to the toner dispenser 52 simply based on the number of copies made. Accordingly, a standard amount of toner powder is added to the magnetic brush developer unit 10 by the toner dispenser 52 based on the number of copies made. For ordinary copies, the developer unit 10 could be replenished with a standard quantity of toner powder, for example, 0.2 grams/copy. However, when the voltage sensor 34 detects heavy toning, three to five times as much toner should be added to the developer unit 10 by the toner dispenser 52.

Figure 2:
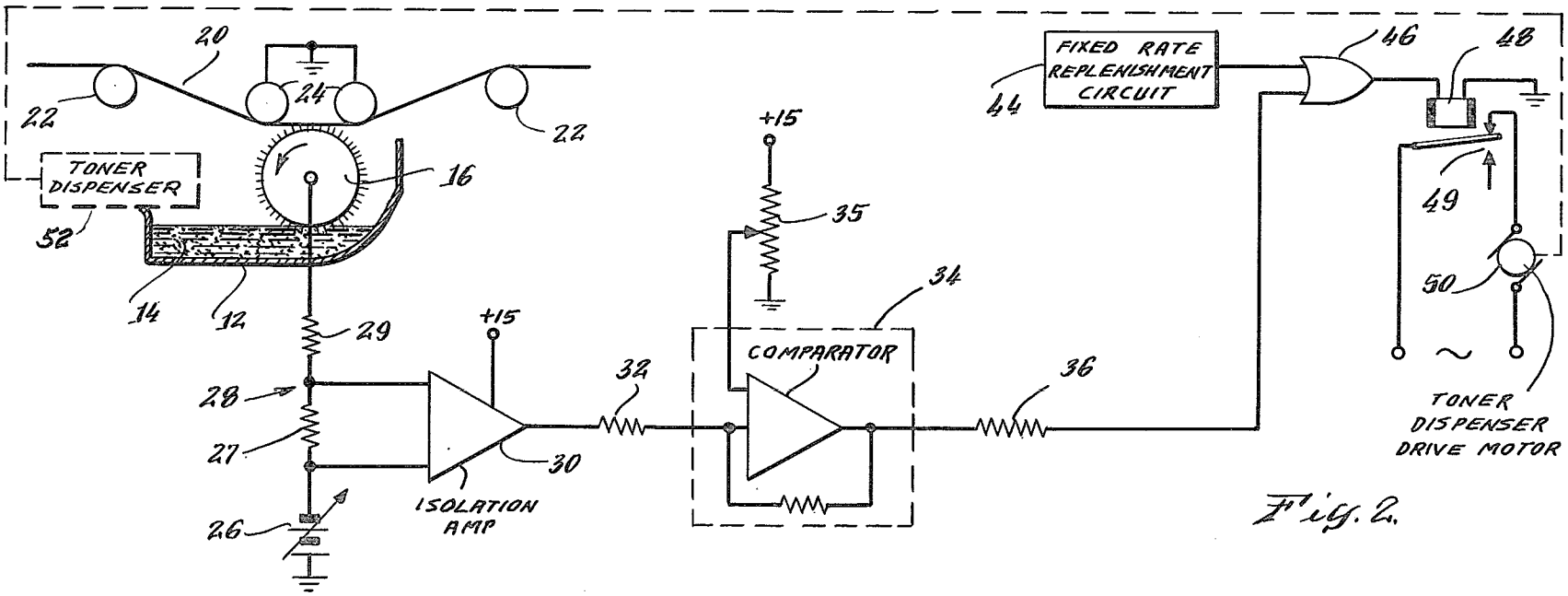
FIG. 2 is a schematic diagram illustrating one way of carrying out the invention shown in FIG. 1.

Referring now to FIG. 2 which illustrates one form of circuitry which may be employed in practicing the present invention, the developer assembly 10 has a container 12 which holds a supply of carrier and toner powder 14. Agitation means are generally provided which are not shown for mixing the carrier and toner powder to maintain a homogeneous mixture thereof. A photoconductor 20 which has been charged with an image is conveyed by a plurality of rollers 22 over a rotating magnetic brush 16 which comes into intimate contact with the photoconductor under bias bars 24. The magnetic brush 16 carries the toner powder to the photoconductor 20 and deposits the toner powder thereon in accordance with the charge on the photoconductor such that the darker the image the more powder is applied thus depleting the supply of toner powder from the container 12 when repetitive copies are being made. A bias supply voltage 26 is fed through a resistance 28 comprised of resistors 27 and 29 directly to the magnetic brush 16. In accordance with the present invention, the voltage across the magnetic brush 16 is sensed from resistance 28 across the resistor 27. It has been found that the magnitude of the voltage change of 50 volts or more takes place when a dark original is copied but only a change of 20 volts or less takes place when a light original sample is copied.

As the bias voltage is lowered, the ability to suppress background decreases. The resistance of the combined resistors 27 and 29, by way of example, may be on the order of 18 megohms. If small values of resistance are used, the voltage changes become difficult to use. On the other hand, higher values of the resistance 28 requires an increased bias supply. Accordingly, on the low end of the resistance, a limitation is provided by sensitivity and on the high side a limitation is provided on the practical size of the bias supply which may be employed. Using a 18 megohm total resistance with a bias supply of 250 to 300 volts will apply a bias on the order of −150 volts to the magnetic brush. Of course, the amount of bias supply to be applied to the magnetic brush will depend on the residual background voltage that is present on the photoconductor 20 and which must be neutralized by the bias supply. The bias supply voltage at its optimum point will also depend on the type and concentration of the toner powder used.

Voltage across the brush 16 is applied from resistor 27 to an isolation amplifier 30 where it is amplified and applied by a resistor 32 to a comparator circuit 34. One input of the comparator 34 has the voltage change from the magnetic brush applied thereto while another terminal has a reference source 35 applied thereto. The level of the reference source 35 which is applied to the comparator 34 will represent an average voltage which is prevalent on the brush 16 while a standard copy is being made. When the voltage changes across the magnetic brush 16 during toning exceed this predetermined average voltage, the comparator 34 provides an output which indicates that a dark copy has been made and therefore that more than a normal replenishment of toner powder is required. The output of the comparator 34 is applied via a resistor 36 to one input of an OR-gate 46 while a fixed replenishment circuit 44 is connected to the other input terminal of the OR-gate 46. The fixed rate replenishment circuit generates a signal based on the number of copies which are made. The outputs from the OR-gate 46 operate a relay 48 and its associated contacts 49 to operate a toner dispenser drive motor 50 which is coupled to the toner dispenser 52. The dispensing rate of the toner dispenser 52 is thus controlled by the fixed rate replenishment circuit 44 and is supplemented thereby when the change of voltage across the magnetic brush 16 exceeds a predetermined amount as detected by the comparator 34 to supplement the standard amount for heavy copy. The toner dispenser mechanism may be of any suitable type, for example, of the type employed in Pitney Bowes Models 4500 or 4520. It should be noted that one of the advantages of the present invention is that in the event of failure of the voltage sensing circuit, toner powder will still be added at a standard rate, thus assuring no complete cessation of replenishment of the toner powder.

Accordingly, the present invention provides a simple, external voltage measuring system for detecting changes in voltage during the toning step which are in excess of a predetermined average voltage change thereby providing an indication that a very dark copy has been made so that more than normal replenishment of toner powder is required in the development assembly. The high value resistor utilized in the stabilized bias supply, stabilizes current variations between the bias supply and the magnetic brush developer unit. The overall effect of this system is to provide better and more consistant copies over longer periods of time.

Since other modifications and changes varied to fit particular operating requirements and environments will be apparent to those skilled in the art, the invention is not considered limited to the examples chosen for purposes of illustration and includes all modifications and changes which do not constitute departure from the true spirit and scope of this invention.

We claim:

1. A powder density control circuit for use in a photocopier machine of the type in which a photoconductor is charged in accordance with an image to be recorded thereon and is developed by contact with a toner powder attracted thereto from a mixture of carrier particles and toner powder carried by a magnetic brush of a developer assembly including a replenishment means for periodically adding toner powder to said machine comprising:

(a) a resistor stabilized bias power supply coupled to the magnetic brush of the developer assembly, (b) means for sensing the change in voltage of the resistor stabilized bias power supply during toning of an image on a photoconductor, and (c) means for controlling the replenishment means in response to a predetermined change in voltage during toning thereby controlling the amount of toner powder which is replenished to the mixture in the developer assembly.

2. The powder density control circuit as set forth in claim 1 wherein said resistor stabilized bias power supply comprises a high value resistor and variable power supply serially connected to the magnetic brush of the developer assembly.

3. The powder density control circuit as set forth in claim 2 wherein the value of said resistor is on the order of 18 megohms and the range of said variable power supply is between 0 to 300 volts.

4. A powder density control circuit for use in a photocopier machine of the type in which a photoconductor is charged in accordance with an image to be recorded thereon and is developed by contact with a toner powder attracted thereto from a mixture of carrier particles and toner powder carried by a magnetic brush of a developer assembly including a replenishment means for periodically adding toner powder to said machine comprising:

(a) a high value resistance, (b) a bias power supply, (c) means for serially coupling said resistance and said bias power supply to the magnetic brush of the developer assembly, (d) a comparator having a reference voltage applied thereto corresponding to the voltage change across the magnetic brush during the toning of a standard copy reproduced by the photocopier machine, said comparator providing an output when another input thereto exceeds said reference voltage, (e) means for sensing the change in voltage on said resistance during toning of the photoconductor, (f) means for applying said change in voltage across said resistance to said comparator thereby producing an output when said change in voltage exceeds said reference voltage, (g) a toner control means for controlling a toner dispenser which adds toner powder to the development assembly when activated, and (h) means for applying the output of said comparator to said toner control means for activating said toner control means thereby adding toner powder to said development assembly when the change in voltage across said resistance exceeds said predetermined reference voltage.

5. The powder density control circuit set forth in claim 1 having a fixed rate replenishment circuit coupled to said toner control means for activating a toner dispenser to add a fixed amount of toner powder to said development assembly based on the number of copies reproduced by said photocopier machine.

6. The powder density control circuit set forth in claim 5 wherein the magnitude of said resistance is on the order of 18 megohms.

* * * * *